US007578688B2

(12) United States Patent
Wu

(10) Patent No.: US 7,578,688 B2
(45) Date of Patent: Aug. 25, 2009

(54) ELECTRICAL CONNECTOR WITH IMPROVED ACTUATOR HAVING PIVOTAL MOVEMENT LIMITING ARRANGEMENT

(75) Inventor: Chun-Kung Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,722

(22) Filed: Jan. 22, 2008

(65) Prior Publication Data

US 2008/0176424 A1 Jul. 24, 2008

(30) Foreign Application Priority Data

Jan. 22, 2007 (CN) ..... 200720033807

(51) Int. Cl.
*H01R 13/15* (2006.01)

(52) U.S. Cl. ..... 439/260; 439/495

(58) Field of Classification Search ..... 439/260, 439/495
See application file for complete search history.

(56) References Cited

U.S. PATENT DOCUMENTS

2006/0292910 A1* 12/2006 Lee et al. ..... 439/260

* cited by examiner

*Primary Examiner*—Ross N Gushi
(74) *Attorney, Agent, or Firm*—Wei Te Chung

(57) ABSTRACT

An electrical connector for connecting a flexible printed circuit, comprising: a housing comprising a base portion and a mating portion extending forwardly from the base portion; a plurality of electrical contacts received in the housing; and an actuator pivotally mounted to the housing for rotating movement between an opened position and a closed position, the actuator comprising a flat member, a pair of supporting mechanism each integrally formed on opposite ends of the flat member, and an arrangement provided adjacent to the supporting mechanism limiting pivotal movement of the actuator when the actuator in the opened position.

20 Claims, 12 Drawing Sheets

ELECTRICAL CONNECTOR WITH IMPROVED ACTUATOR HAVING PIVOTAL MOVEMENT LIMITING ARRANGEMENT

BACKGROUND OF THE INVENTION

1. Field of the Invention

The present invention is generally related to the art of electrical connectors, and more particularly, to an electrical connector used for connecting a flexible printed circuit or a flexible flat cable. The electrical connector includes an actuator having an arrangement for limiting pivotal movement of the actuator when the actuator in an opened position.

2. Description of Related Art

A variety of flexible printed circuits are widely used in electronic devices, such as notebooks, mobile phones and fax machines, so as to interconnect motherboard and electronic device, such as a display, if in a notebook computer. Various electrical connectors are adapted for connecting corresponding flexible printed circuits. There is a conventional FPC (flexible printed circuit) connector disclosed in U.S. Pat. No. 7,052,300. The FPC connector comprises an insulated housing, a plurality of front electrical contacts and rear electrical contacts, an actuator mounted to the housing and a pair of positioning members. The housing has a pair of concave portions formed on opposite lateral ends thereof and opening upwardly to exterior. The actuator has a pair of shafts received in the corresponding concave portions. The shafts of the actuator are pivotable in the concave portions respectively between a closed position and an opened position.

SUMMARY OF THE INVENTION

An object, therefore, of the invention is to provide a new and improved electrical connector for flat electrical cables, of the character described.

In order to achieve the object set forth, an electrical connector for connecting a flexible printed circuit, comprising: a housing comprising a base portion and a mating portion extending forwardly from the base portion; a plurality of electrical contacts received in the housing; and an actuator pivotally mounted to the housing for rotating movement between an opened position and a closed position, the actuator comprising a flat member, a pair of supporting mechanism each integrally formed on opposite ends of the flat member, and an arrangement provided adjacent to the supporting mechanism limiting pivotal movement of the actuator when the actuator in the opened position.

Other objects, advantages and novel features of the present invention will be drawn from the following detailed description of a preferred embodiment of the present invention with attached drawings.

DETAILED DESCRIPTION OF THE INVENTION

Referring to FIGS. 1 to 8, description will be made of a electrical connector according to a first embodiment of the present invention.

Figure 1:
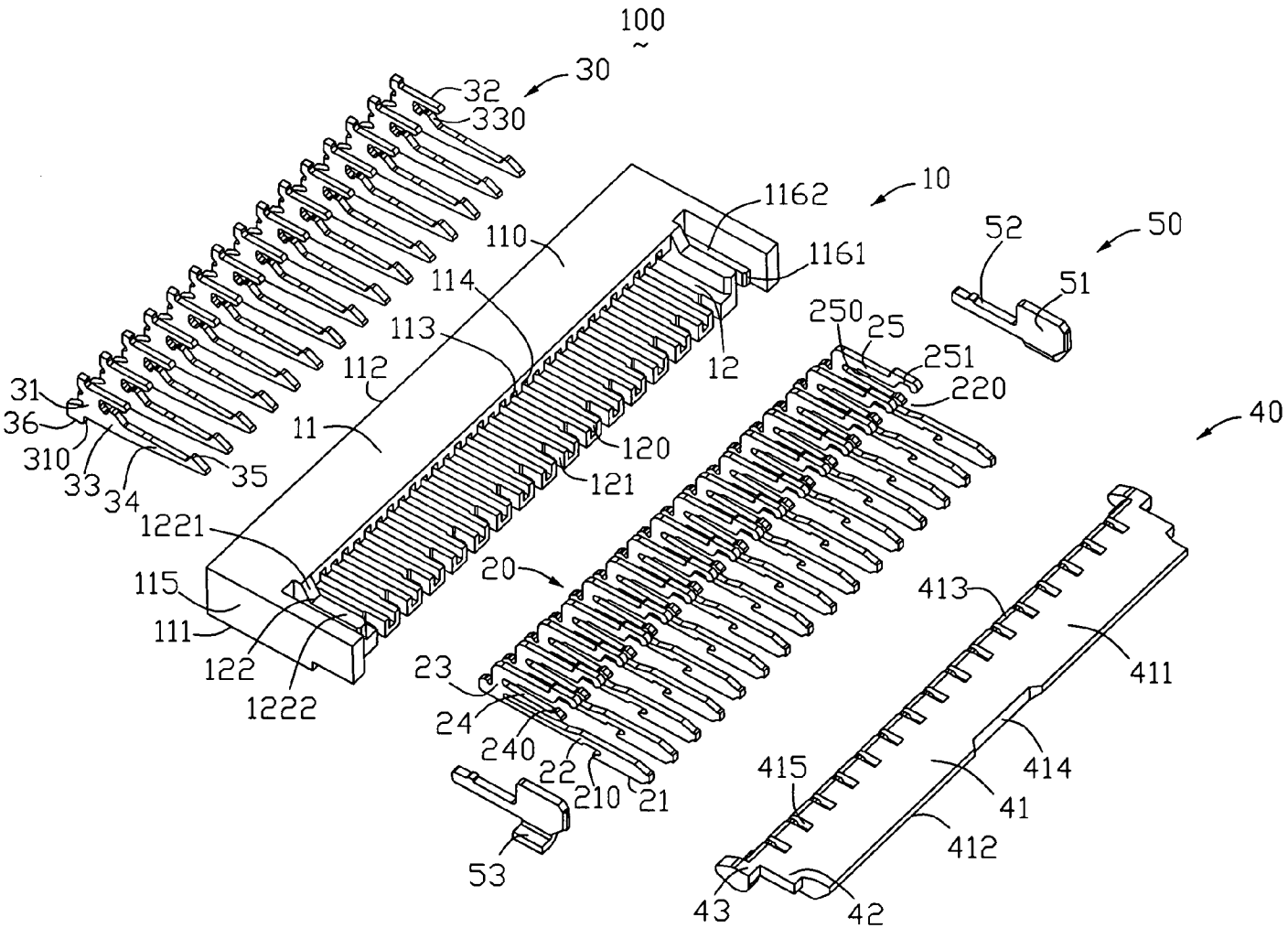
FIG. 1 is an exploded, perspective view of an electrical connector in accordance with a first embodiment of the present invention.
Figure 2:
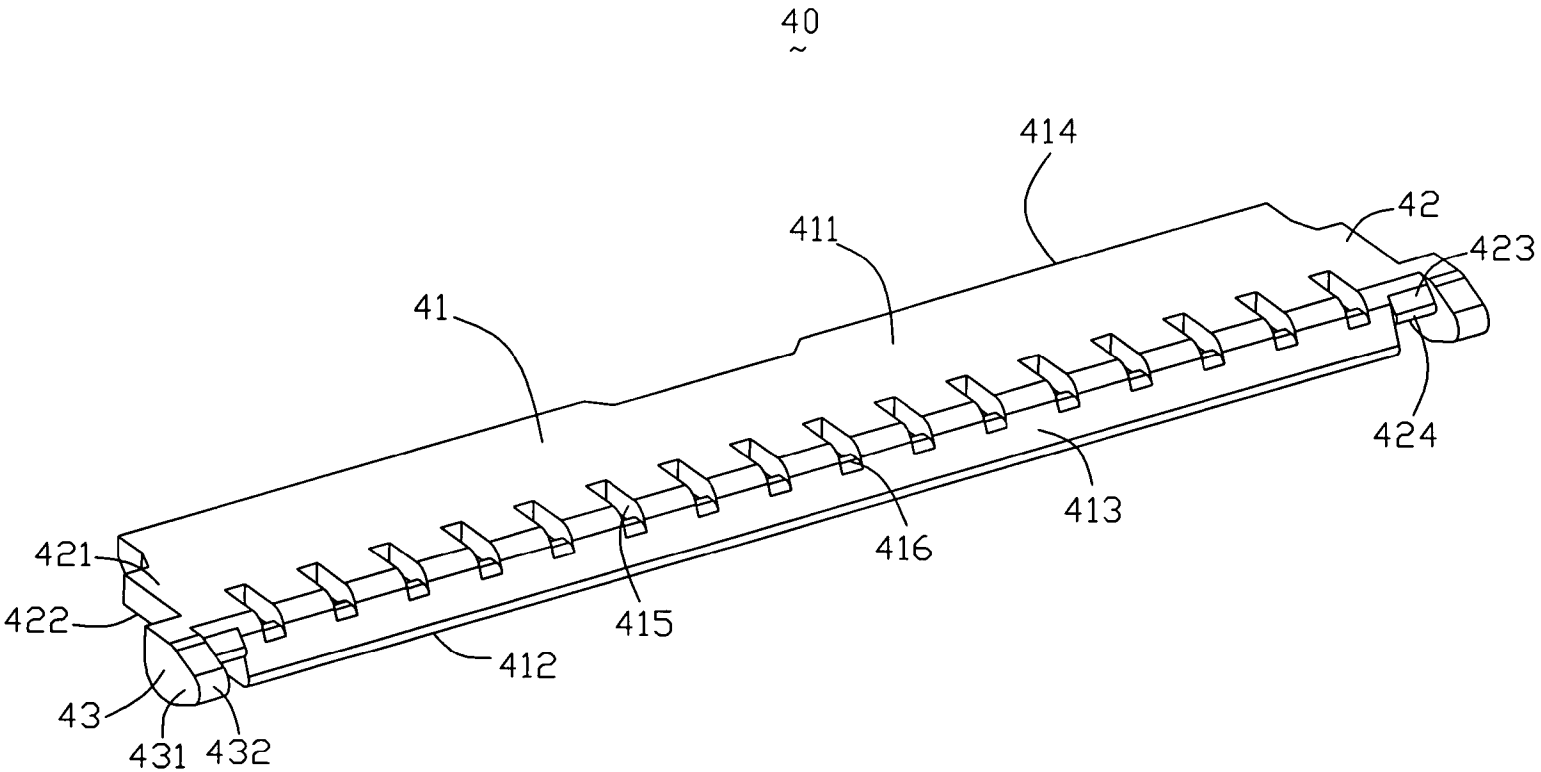
FIG. 2 shows an actuator of the FIG. 1.

Referring to FIG. 1, an electrical connector 100 in accordance with the present invention is provided for electrically connecting a flexible printed circuit (not shown). The electrical connector 100 comprises an insulated housing 10, a plurality of front electrical contacts 20 and rear electrical contacts 30, an actuator 40 mounted to the housing 10 for rotating movement between an opened position and a closed position, and a pair of positioning members 50.

Figure 3:
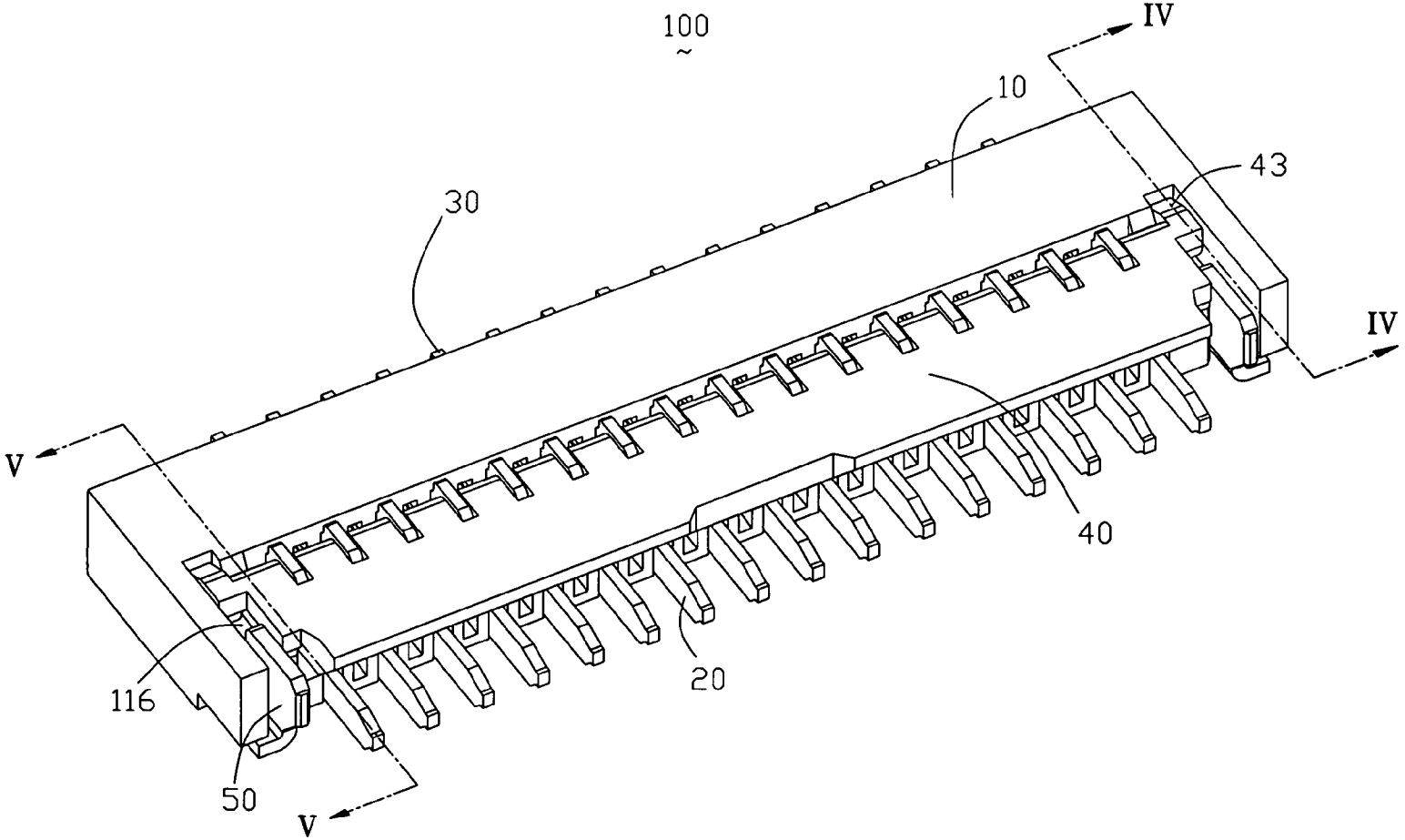
FIG. 3 is an assembled, perspective view of the electrical connector illustrated in FIG. 1, wherein the actuator of the electrical connector is set in a closed position.
Figure 4:
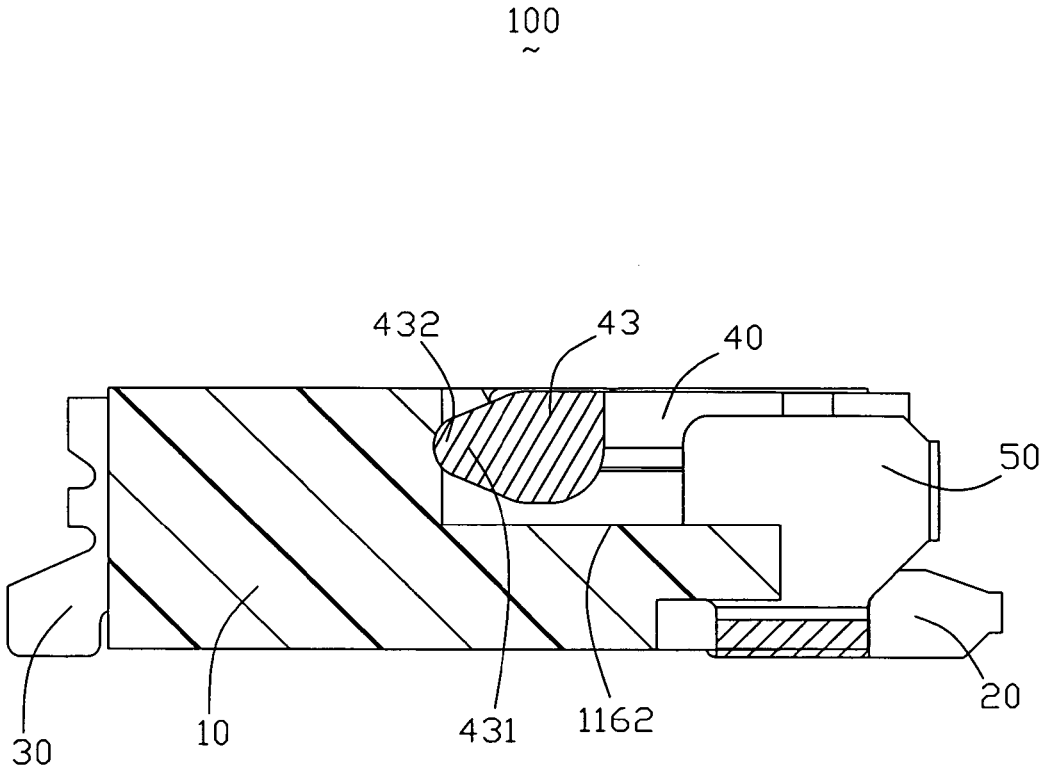
FIG. 4 is a cross-sectional view of the electrical connector, taken along line IV-IV of FIG. 3.
Figure 5:
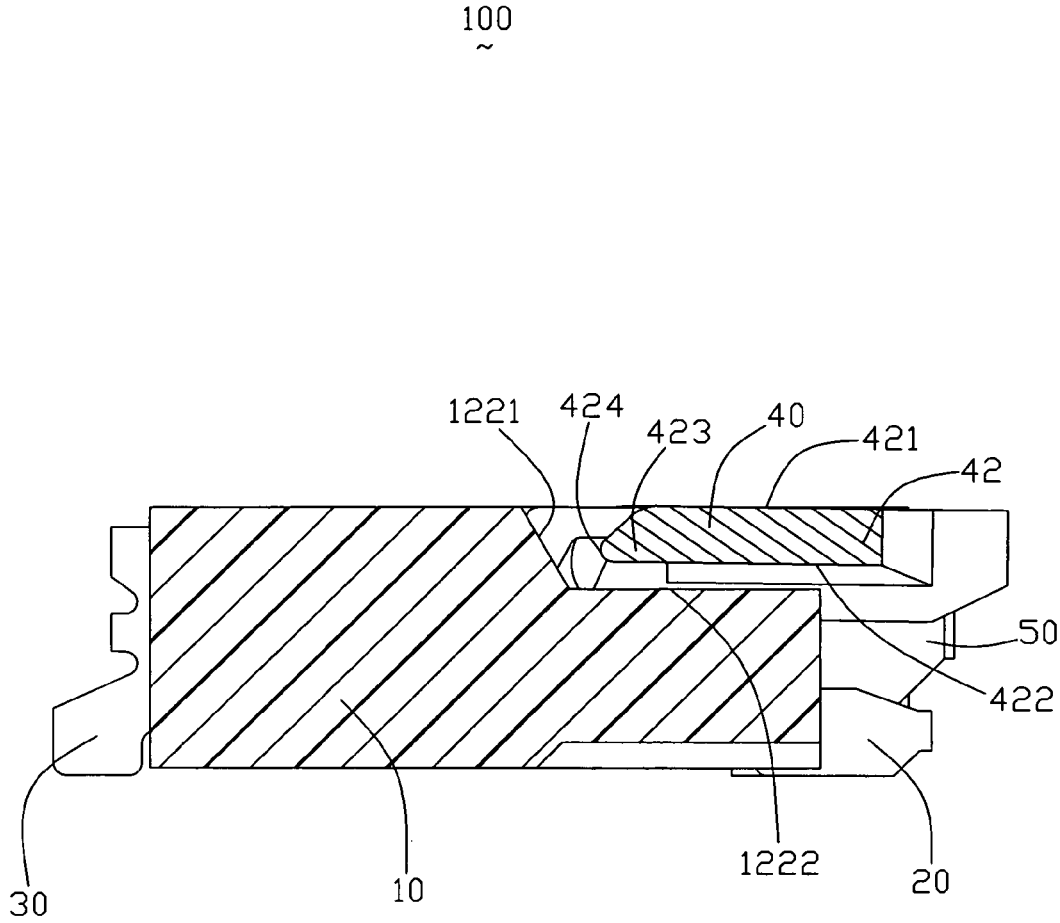
FIG. 5 is a cross-sectional view of the electrical connector, taken along line V-V of FIG. 3.

Referring to FIG. 1 and FIG. 3, the insulated housing 10 is approximately rectangular and comprises a base portion 11 and a mating portion 12 extending forwardly from the base portion 11. The base portion 11 includes a top surface 110, a bottom surface 111 opposite to the top surface 110 and a rear surface 112. The mating portion 12 defines a plurality of first grooves 120 and a plurality of first passageways 121 thereon. The first grooves 120 and the first passageways 121 are arranged alternately along the longitudinal direction. A plurality of second grooves 113 extends backwardly from the first grooves 120 respectively having a plurality of corresponding first fixing holes (not labeled) formed on the rear surface 112. A plurality of second passageways 114 extends backwardly from the first passageways 121 respectively having a plurality of corresponding second fixing holes (not labeled) formed on the rear surface 112. Each second groove 113 has a beam (not labeled) for preventing the rear contacts 30 from moving forwardly. The mating portion 12 further comprises a pair of positioning portions 122 formed on opposite lateral ends thereof. Each positioning portion 122 defines a downward inclined surface 1221 connecting the top surface 110 of the base portion 11 and a first planar surface 1222 extending forwardly from the bottom end of the inclined surface 1221. A pair of arm portions 115 extends outwardly and forwardly from opposite lateral ends of the base portion 11 and apart from the mating portion 12 a distance. A pivot seat 116 is defined between the positioning portion 122 and the arm portion 115. The pivot seat 116 includes a pressing portion 1161 and a positioning slot (not labeled) abutting against the pressing portion 1161. The pressing portion 1161 has a second planar surface 1162, and the positioning slot for receiving the specific structure of the corresponding positioning member 50.

Figure 6:
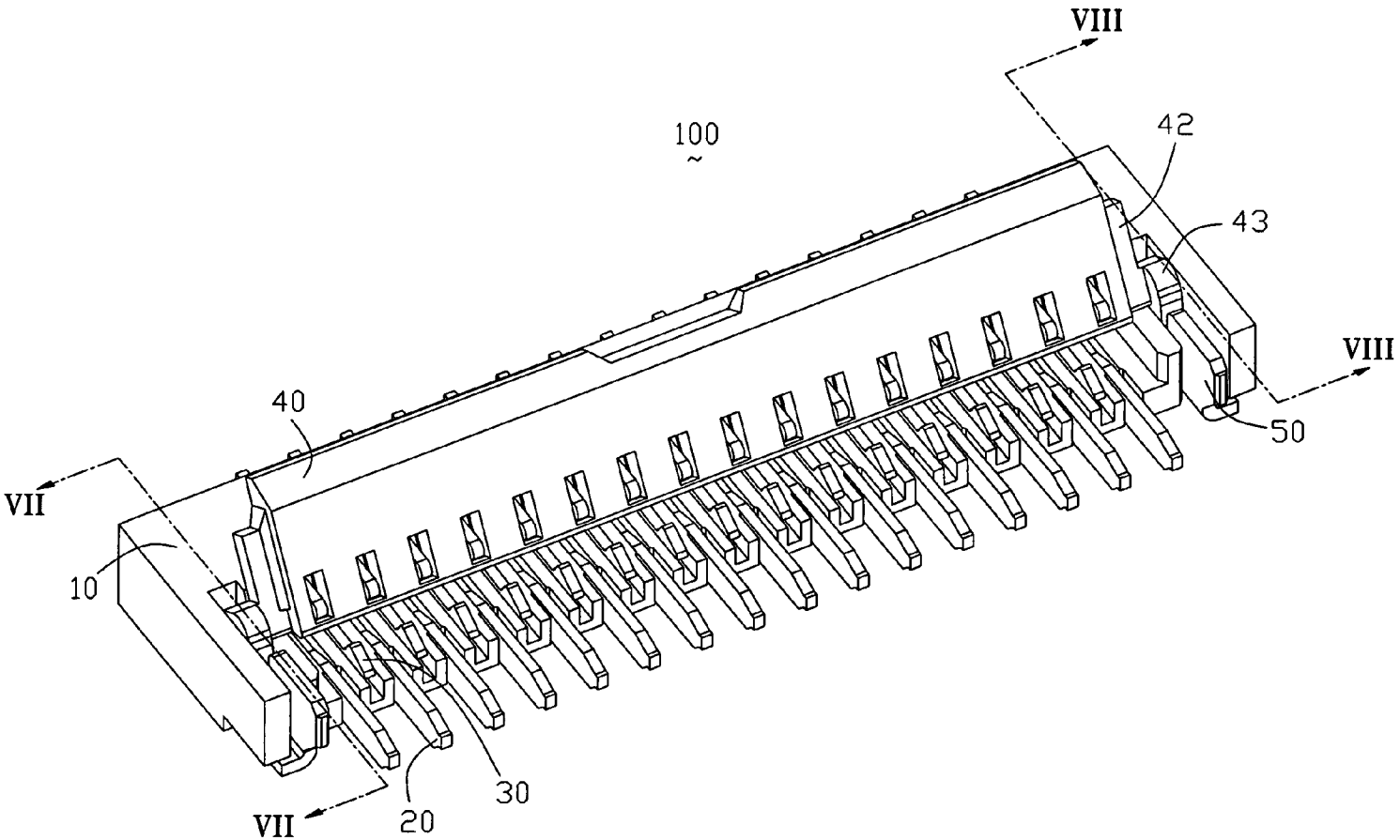
FIG. 6 is an assembled, perspective view of the electrical connector illustrated in FIG. 1, wherein the actuator of the electrical connector is set in an opened position.
Figure 7:
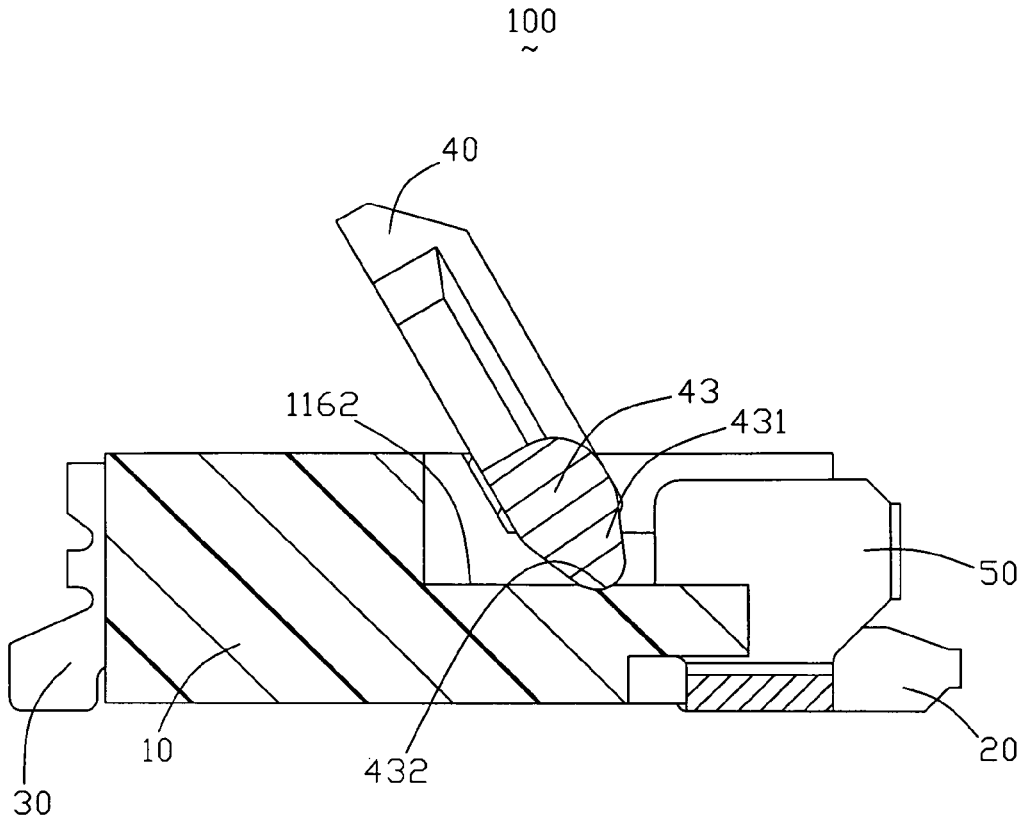
FIG. 7 is a cross-sectional view of the electrical connector, taken along line VII-VII of FIG. 6.
Figure 8:
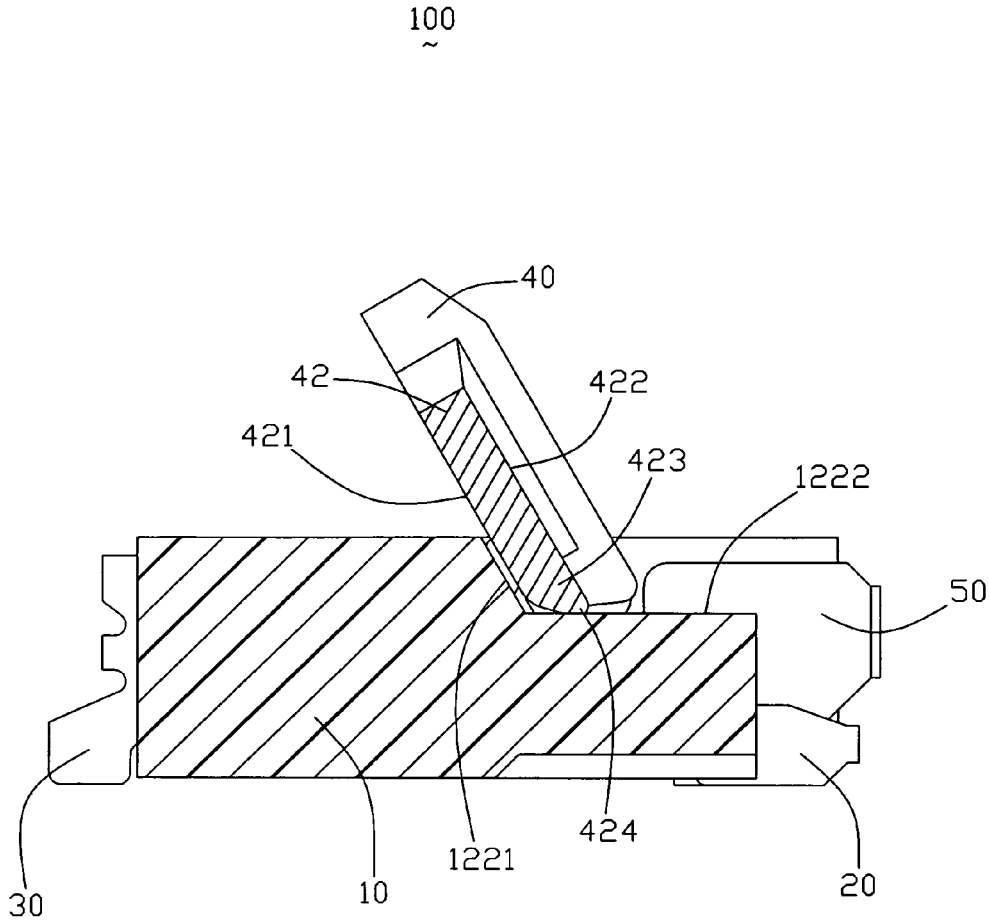
FIG. 8 is a cross-sectional view of the electrical connector, taken along line VIII-VIII of FIG. 6.

Referring to FIG. 1 and in conjunction with FIGS. 3 and 6. The front electrical contacts 20 are secured respectively in the corresponding passageways 121, 114 of the housing 10. Each front contact 20 comprises a solder portion 21 extending out of the front end of the mating portion 12, a connect portion 22 extending backwardly from the solder portion 21 and received in the first passageway 121 of the mating portion 12, a first main portion 23 connected with the connect portion 22 and secured in the second passageway 114 of base portion 11, a resilient arm 24 extending forwardly from the first main portion 23, and a support arm 25 extending forwardly from the first main portion 23 and paralleling with the resilient arm 24. The solder portion 21 has a barrier 210 which abuts against the bottom wall of first passageway 121 for preventing the front contacts 20 from moving backwardly. The resilient arm 24 has a contact portion 240 projecting upwardly at a cantilever end thereof. A receiving space 250 is provided between the support arm 25 and the resilient arm 24 for receiving the flexible printed circuit. A gap 220 is formed between the resilient arm 24 and the connect portion 22. When the flexible printed circuit is inserted into the receiving space 250, the resilient arm 24 is pressed into the gap 220. The support arm 25 has a pivot portion 251 which is arched in shape and opens to the receiving space 250.

Referring to FIG. 1 and in conjunction with FIGS. 3 and 6 too. The rear electrical contacts 30 are secured respectively in the passageways 113, 120 from the rear surface 112 of the base portion 11. Each of rear electrical contacts 30 comprises a second main portion 31 secured in the corresponding second groove 113, a balance beam 32 extending forwardly from the second main portion 31 and pressing on the beam of the second groove 113, a retention portion 33 extending forwardly from the bottom portion of the main portion 31, a resilient beam 34 extending forwardly from the retention portion 33 and a tail portion 36 connecting with the second main portion 31 and opposite to the resilient beam 34. The resilient beam 34 has a contact portion 35 projecting upwardly from the upper surface of the resilient beam 34. A stopper 310 projects from the bottom surface of the second main portion 31 to prevent the rear contacts 30 from moving forwardly. The retention portion 33 has barbs 330 on the upper surface thereof for fixing the rear contacts 30 in the housing 10.

Referring to FIG. 1 to FIG. 8, the actuator 40 is unitarily molded of dielectric material such as plastic or the like. The actuator 40 comprises a major transverse flat member 41 large enough to cover the mating portion 12 of the housing 10, a pair of flanges 42 is integrally formed with opposite sides of the transverse flat member 41, and a shaft 43 extending laterally outwardly from the outer surface of the each flange 42. The flat member 41 defines a first surface 411, a second surface 412 opposite to the first surface 411, a first margin 413 connecting the first surface 411 and the second surface 412, a second margin 414 opposite to the first margin 413, and a plurality of cutouts 415 extending from the first margin 413 toward the second margin 414 and extending along up-down direction though the member 41. Each cutout 415 has a turning pintle 416 corresponding to the pivot portion 251 of the front electrical contact 20 therein. The turning pintle 416 and the shaft 43 have the same central axis. Each flange 42 includes a first side 421, a second side 422 opposite to the first side 421, and a first cam 423 near the first margin 413. The first cam 423 is generally triangular, and has a first supporting portion 424 locating at the bottom end of the first cam 423 for engaging the first planar surface 1222 of the positioning portion 122 when the actuator 40 in the opened position. The first supporting portion 424 stands back from the junction of the inclined surface 1221 and the first planar surface 1222 in the horizontal direction. With this distance, the first cam 423 is aloof from the inclined surface 1221 of the positioning portion 122 when the actuator 40 in the closed position, so that the actuator 40 continues pivotable before the actuator 40 in a verticality with the first planar surface 1222 until the first side 421 looking onto the inclined surface 1221. Each shaft 43 has a second cam 431 extending toward the same direction with the first cam 423. The second cam 431 has a second supporting portion 432 for engaging the second planar surface 1162 of the pressing portion 1161 when the actuator 40 in the opened position. The second cam 431 and the first cam 423 extend the proper length respectively. When the actuator 40 is perpendicular with housing 10, the second supporting portion 432 engaging the second planar surface 1162 of the pressing portion 1161 and the first supporting portion 424 engaging the first planar surface 1222 of the positioning portion 122 at the same time so as to avoid the second supporting portion 432 or the first supporting portion 424 hanging in the air.

When the actuator 40 is top-down located into the housing 10, the shafts 43 are received in the corresponding pivot seat 116, each turning pintle 416 respectively engages with the pivot portion 251 of the front electrical contact 20 and the second surface 412 of the flat member 41 presses the flexible printed circuit to electrical contact with the electrical contacts 20, 30. As the pivot portion 251 opens downwardly toward receiving space 250, and pivot seat 116 opens upwardly to exterior, thus, when the actuator 40 is rotated from the opened position to the closed position, it is hardly occurred that the actuator 40 breaks off the housing 10. Accordingly, the arrangement of the connector 100 ensures that the stable and reliable electrical connection is provided between the connector 100 and the flexible printed circuit.

Referring to FIG. 1, each positioning member 50 comprises a body portion 51, a retention portion 52 extending backwardly from the end of the body portion 51 and secured in the positioning slot of the housing 10, and a fixing portion 53. The body portion 51 received in the pivoting seat 116 for limiting the capacity of the pivoting seat 116. When the electrical connector 100 is mounted to a printed circuit board (not labeled), the solder portions 21 of the front contacts 20 and the tail portions 36 of the rear contacts 30 are soldered on the printed circuit board. Furthermore, the fixing portions 53 of the pair of positioning members 50 are also soldered on the printed circuit board so that the positioning members 50 improve the performance of the connection between the connector 100 and printed circuit board.

Referring to FIG. 1 to FIG. 8, when the actuator 40 located in the opened position, the supporting portions 424, 432 can engage the planar surfaces 1222, 1162 respectively for limiting pivotal movement of the actuator 40 in order that the flexible printed circuit is inserted into the receiving space 250 easily, with zero insertion force or low insertion force. When the actuator 40 is rotated from the opened position to the closed position, the member 41 presses the flexible printed circuit against the front contacts 20 and the rear contacts 30, thus the contact portions 240, 35 of the front contacts 20 and the rear contacts 30 electrically contact with corresponding portions of the flexible printed circuit.

Figure 9:
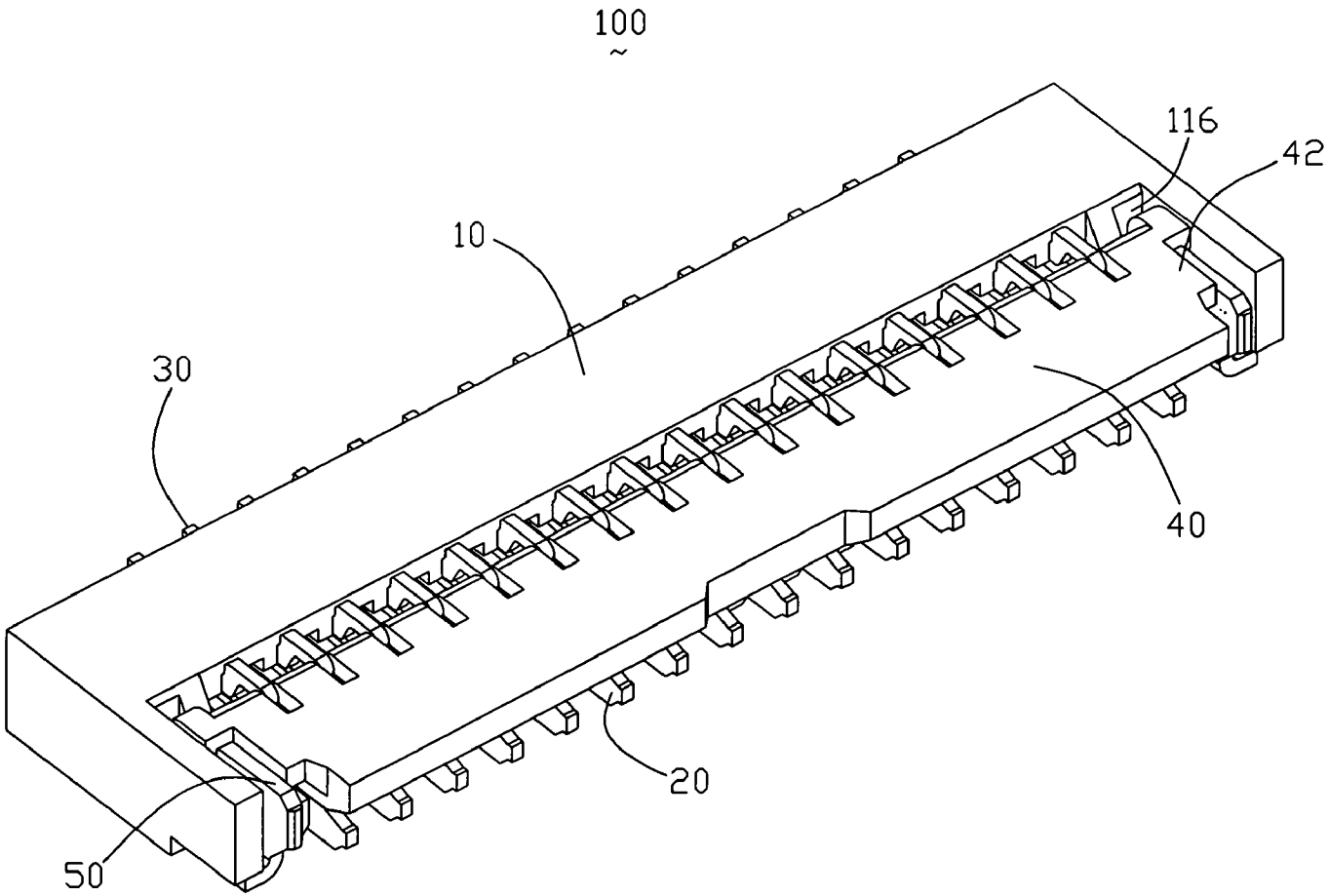
FIG. 9 is an assembled, perspective view of an electrical connector in accordance with a second embodiment of the present invention.
Figure 10:
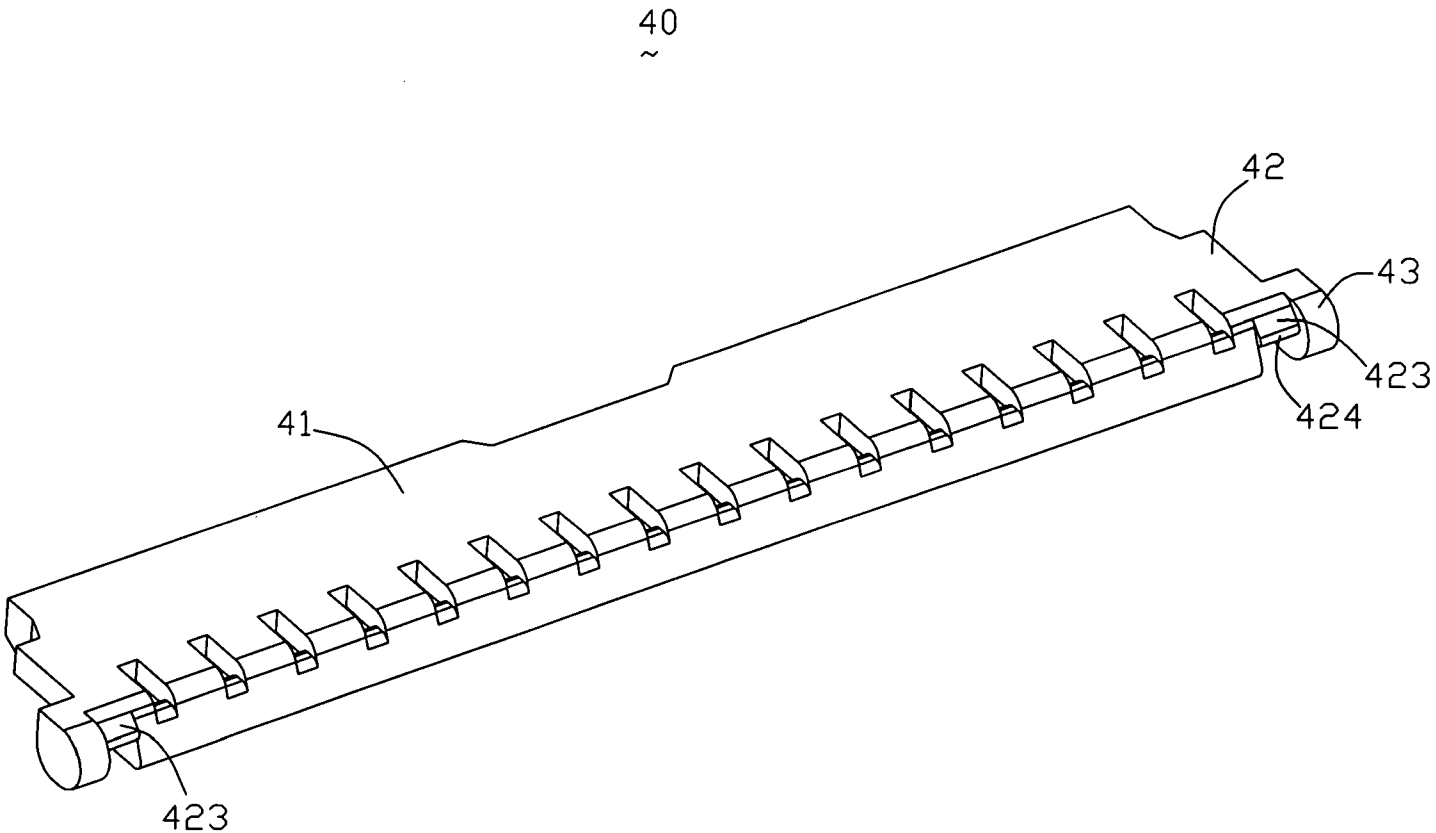
FIG. 10 shows an actuator of the FIG. 9.

Referring to FIGS. 9 and 10, description will be made of a connector according to a second embodiment of the present invention. Similar parts are designated by like reference numerals and will not be described any longer.

The second embodiment of the present invention only has a change at the actuator 40. The actuator 40 comprises a major flat member 41 large enough to cover the mating portion 11 of the housing 10, a pair of flanges 42 is integrally formed with opposite sides of the flat member 41, and a shaft 43 extending laterally outwardly from the outer surface of the each flange 42. The alternative of the flange 42 and the shaft 43 that the flange 42 including a cam 423 near the shaft having a supporting portion 424 that can engage the second planar surface 1222 of the housing 10 and limit pivotal movement of the actuator 40 when the actuator 40 in the opened position.

Figure 11:
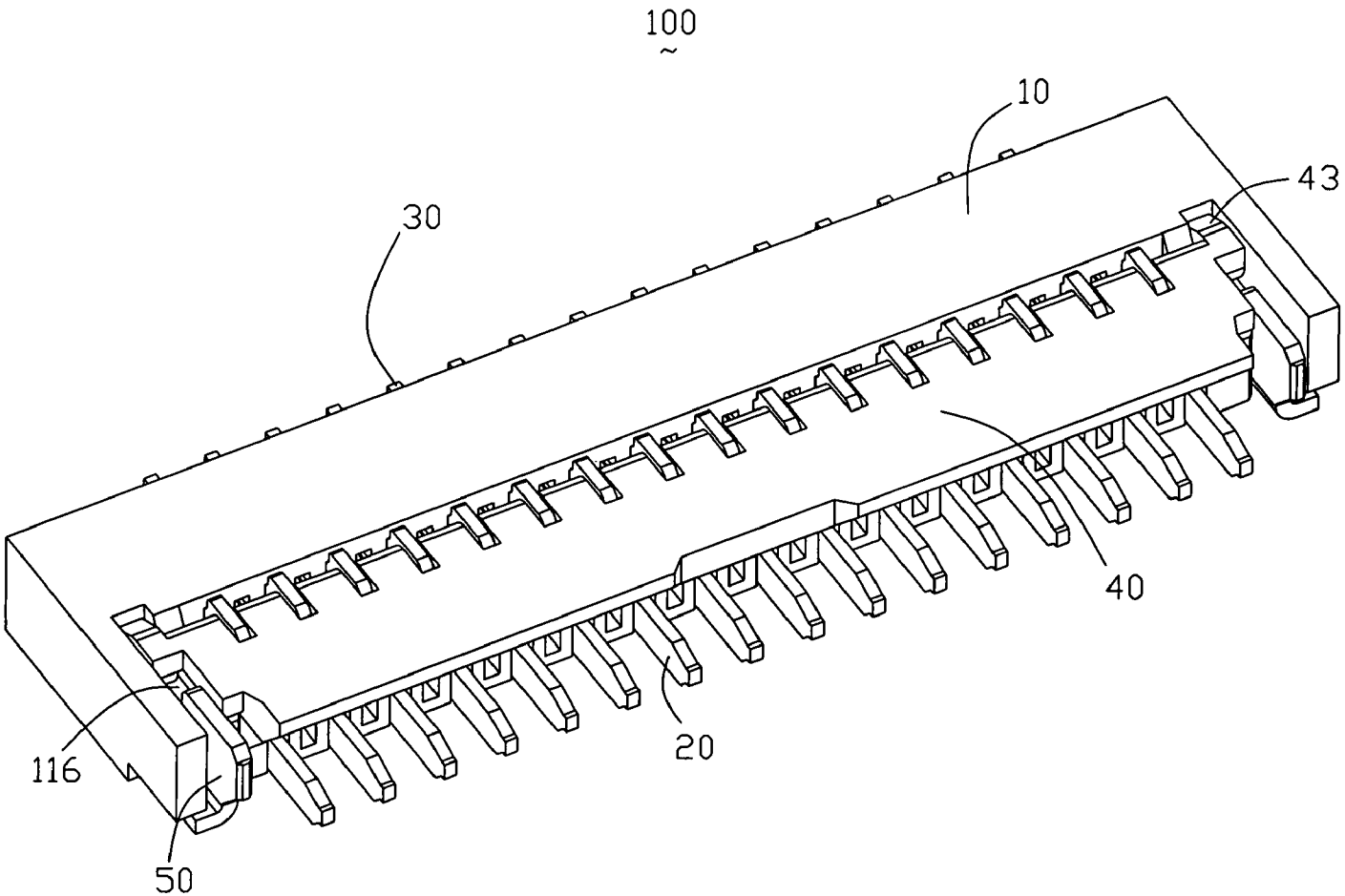
FIG. 11 is an assembled, perspective view of an electrical connector in accordance with a third embodiment of the present invention.
Figure 12:
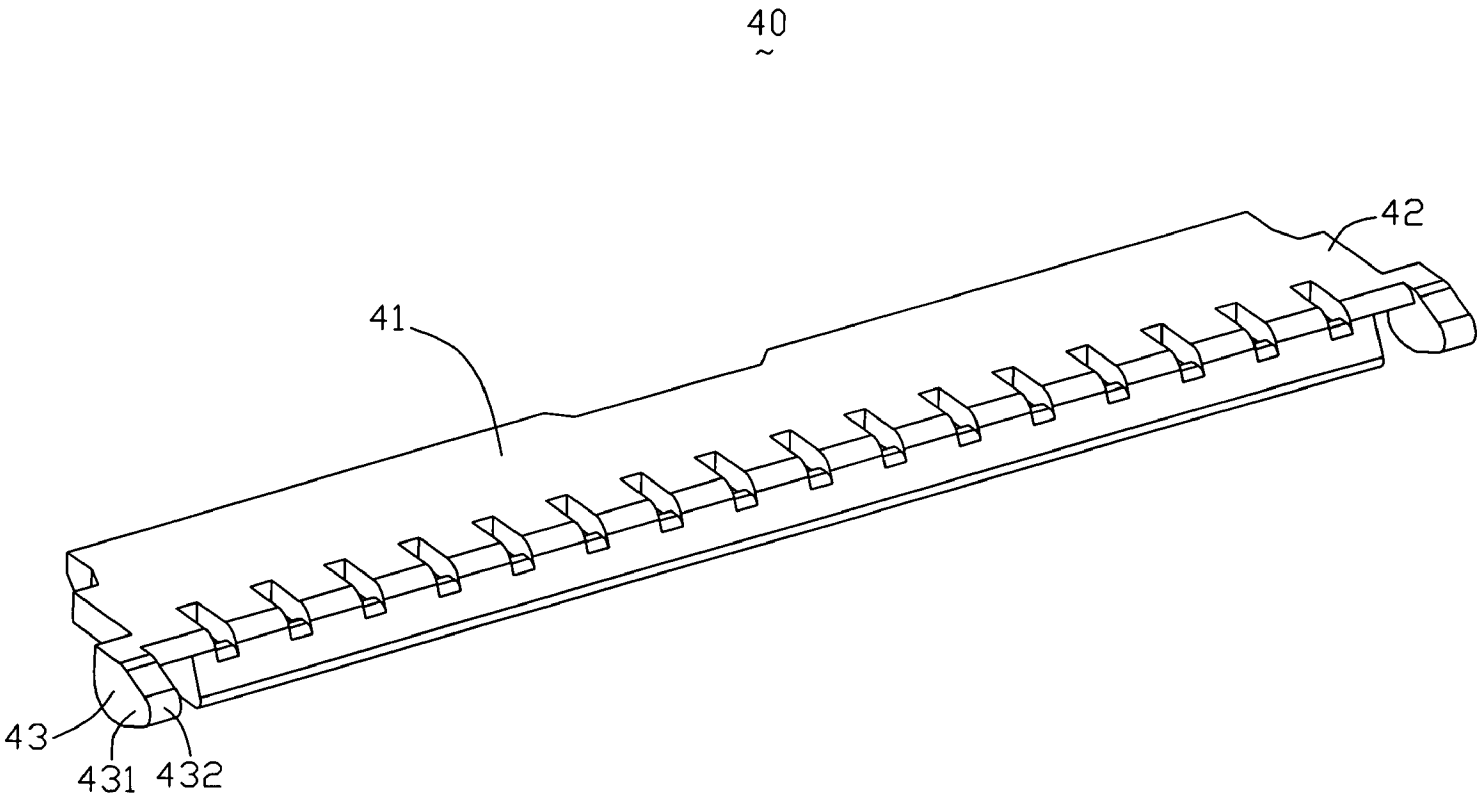
FIG. 12 shows an actuator of the FIG. 11.

Referring to FIGS. 10 and 11, description will be made of a connector according to a third embodiment of the present invention. Similar parts are designated by like reference numerals and will not be described any longer.

The third embodiment of the present invention only has a change at the actuator 40. The actuator 40 comprises a major flat member 41 large enough to cover the mating portion 11 of the housing 10, a pair of flanges 42 is integrally formed with opposite sides of the flat member 41, and a shaft 43 extending laterally outwardly from the outer surface of the each flange 42. The alternative of the flange 42 and the shaft 43 that the shaft 43 including a cam 431 having a supporting portion 432 that can engage the second planar surface 1162 of the housing 10 and limit pivotal movement of the actuator 40 when the actuator 40 in the opened position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms which the appended claims are expressed.

What is claimed is:

1. An electrical connector for connecting a flexible printed circuit, comprising:

a housing comprising a base portion and a mating portion extending forwardly from the base portion, a pair of positioning portions formed on opposite lateral ends of the mating portion respectively, each said positioning portion having a first planar surface and a inclined surface connecting the first planar surface;

a plurality of electrical contacts received in the housing; and an actuator pivotally mounted to the housing for rotating movement between an opened position and a closed position, the actuator comprising a flat member, a pair of supporting mechanism each integrally formed on opposite ends of the flat member, and an arrangement provided adjacent to the supporting mechanism for engaging the first planar surface so as to retain the actuator in position when said actuator is rotated to an open position.

2. The electrical connector as claimed in claim 1, wherein the supporting mechanism comprises a flange connecting the flat member and a shaft extending laterally outwardly from the flange.

3. The electrical connector as claimed in claim 2, wherein the arrangement is defined at the flange having a first supporting portion that can engage the first planar surface of the housing and limit pivotal movement of the actuator when the actuator in the opened position.

4. The electrical connector as claimed in claim 3, wherein the first supporting portion stands back from the junction of the inclined surface and the planar surface in the horizontal direction.

5. The electrical connector as claimed in claim 4, wherein each flange further includes a first side and a second side opposite to the first side, and the first side looking onto the inclined surface when the actuator in the opened position.

6. The electrical connector as claimed in claim 5, wherein the housing defines a plurality of passageways and a plurality of grooves, the grooves and the passageways are arranged alternately along the longitudinal direction.

7. The electrical connector as claimed in claim 6, wherein the electrical contacts comprises a plurality of front electrical contacts and a plurality of rear electrical.

8. The electrical connector as claimed in claim 7, wherein the front electrical contacts respectively received in the passageways of the housing and the rear electrical contacts respectively received in the grooves of the housing.

9. The electrical connector as claimed in claim 8, wherein each front electrical contact comprises a support arm defining a pivot portion which opens downwardly.

10. The electrical connector as claimed in claim 9, wherein each front contact further comprises a solder portion extending out of the front end of the mating portion, a connect portion extending backwardly from the solder portion and received in the mating portion, a first main portion connected with the connect portion and secured in the base portion, a resilient arm extending forwardly from the first main portion, and a support arm extending forwardly from the first main portion and paralleling with the resilient arm.

11. The electrical connector as claimed in claim 10, wherein the solder portion of the front electrical contact has a barrier for preventing the front electrical contact from moving backwardly.

12. The electrical connector as claimed in claim 11, wherein each rear electrical contact comprises a second main portion secured in the base portion, a balance beam extending forwardly from the second main portion, a retention portion extending forwardly from the bottom portion of the main portion, a resilient beam extending forwardly from the retention portion and a tail portion connecting with the second main portion and opposite to the resilient beam.

13. The electrical connector as claimed in claim 12, wherein the plat member defines a plurality of cutouts therein, and a plurality of turning pintles are respectively formed in corresponding cutouts.

14. The electrical connector as claimed in claim 13, further comprises a pair of positioning members received in the pivot seats respectively.

15. An electrical connector comprises:

an insulative housing defining a receiving space for receiving a flexible printed circuit (FPC);

a plurality of contacts disposed in the housing with a resilient arm having a contact portion thereon for engagement with the FPC, and further with a support arm, which is located above the contact portion, having a pivot portion which is arched in shape an engagement; and an actuator positioned upon the housing with a plurality of pivot axes respectively engaged with the corresponding pivot portions, respectively, so as to be pivotally moved relative to the housing; wherein two outermost ends of said actuator define cam structures having respective supporting portions to engage corresponding portions of the housing so as to retain the actuator in position when said actuator is rotated to an open position; wherein said cam structures are upwardly exposed to an exterior.

16. The electrical connector as claimed in claim 15, further including a pair of positioning members attached to said two opposite ends of the housing, each of said positioning members with a fixing portion for securing to a printed circuit board, and a body portion distantly aligned with the corresponding cam structure in a front-to-back direction without engagement therebetween.

17. The electrical connector as claimed in claim 15, wherein said corresponding portion of the housing for engagement with the supporting portion of the cam structure, upwardly faces toward the exterior.

18. The electrical connector as claimed in claim 15, wherein the housing defines a groove structure above the corresponding portion to restrainedly receive the cam structure therein.

19. An electrical connector for connecting a flexible printed circuit, comprising:

a housing comprising a base portion, a mating portion extending forwardly from the base portion, and a pair of arm portions extending outwardly and forwardly from opposite lateral ends of the base portion and apart from the mating portion a distance, a pivot seat defined between the mating portion and the arm portion, the pivot seat defining a pressing portion having a second planar surface;

a plurality of electrical contacts received in the housing; and an actuator pivotally mounted to the housing for rotating movement between an opened position and a closed position, the actuator comprising a flat member, a pair of supporting mechanism each integrally formed on opposite ends of the flat member, and an arrangement provided adjacent to the supporting mechanism for engaging the second planar surface so as to retain the actuator in position when said actuator is rotated to an open position.

20. The electrical connector as claimed in claim 19, wherein the supporting mechanism having a shaft extending laterally outwardly from the flat member, the shaft received in the pivot seat, and the arrangement is defined at the shaft having a second supporting portion that can engage the second planar surface of the housing and limit pivotal movement of the actuator when the actuator in the opened position.

* * * * *